US007875782B1

(12) United States Patent
Nechville

(10) Patent No.: US 7,875,782 B1
(45) Date of Patent: Jan. 25, 2011

(54) ADJUSTABLE AND REMOVABLE NECK FOR A STRINGED INSTRUMENT

(76) Inventor: Thomas Nechville, 10021 3rd Ave. S., Bloomington, MN (US) 55420

( * ) Notice: Subject to any disclaimer, the term of this patent is extended or adjusted under 35 U.S.C. 154(b) by 265 days.

(21) Appl. No.: 12/058,730

(22) Filed: Mar. 30, 2008

(51) Int. Cl.
*G10D 3/00* (2006.01)

(52) U.S. Cl. ..... 84/293; 84/173

(58) Field of Classification Search ..... 84/293
See application file for complete search history.

(56) References Cited

U.S. PATENT DOCUMENTS 3,678,795 A * 7/1972 Fullerton ..... 84/293
4,638,708 A * 1/1987 Kamal ..... 84/293
5,033,349 A * 7/1991 Nechville ..... 84/272
5,452,637 A * 9/1995 DeCola ..... 84/291
5,469,770 A * 11/1995 Taylor ..... 84/291
6,028,255 A * 2/2000 Myronyk ..... 84/293
6,051,766 A * 4/2000 Taylor ..... 84/293
7,157,634 B1 * 1/2007 Babicz ..... 84/293
2007/0277665 A1 * 12/2007 Kroeger et al. ..... 84/293

* cited by examiner

*Primary Examiner*—Elvin G Enad
*Assistant Examiner*—Christopher Uhlir
(74) *Attorney, Agent, or Firm*—Edward H. Weck

(57) ABSTRACT

A musical instrument includes a neck, a body, a playing surface covering the body, a plurality of strings, and a connective element. The connective element varies the distance of the plurality of strings from the playing surface of the instrument. The connective element includes a set screw and a receiving unit having an inclined surface. The set screw contacts the inclined surface on the receiving unit and adjustably fastens the receiving unit to the body and the neck. along a radiused neck surface and a radiused body surface. The connective element may be attached to a removable interface between the neck and the body. The musical instrument may be completely disassembled for transport.

13 Claims, 7 Drawing Sheets

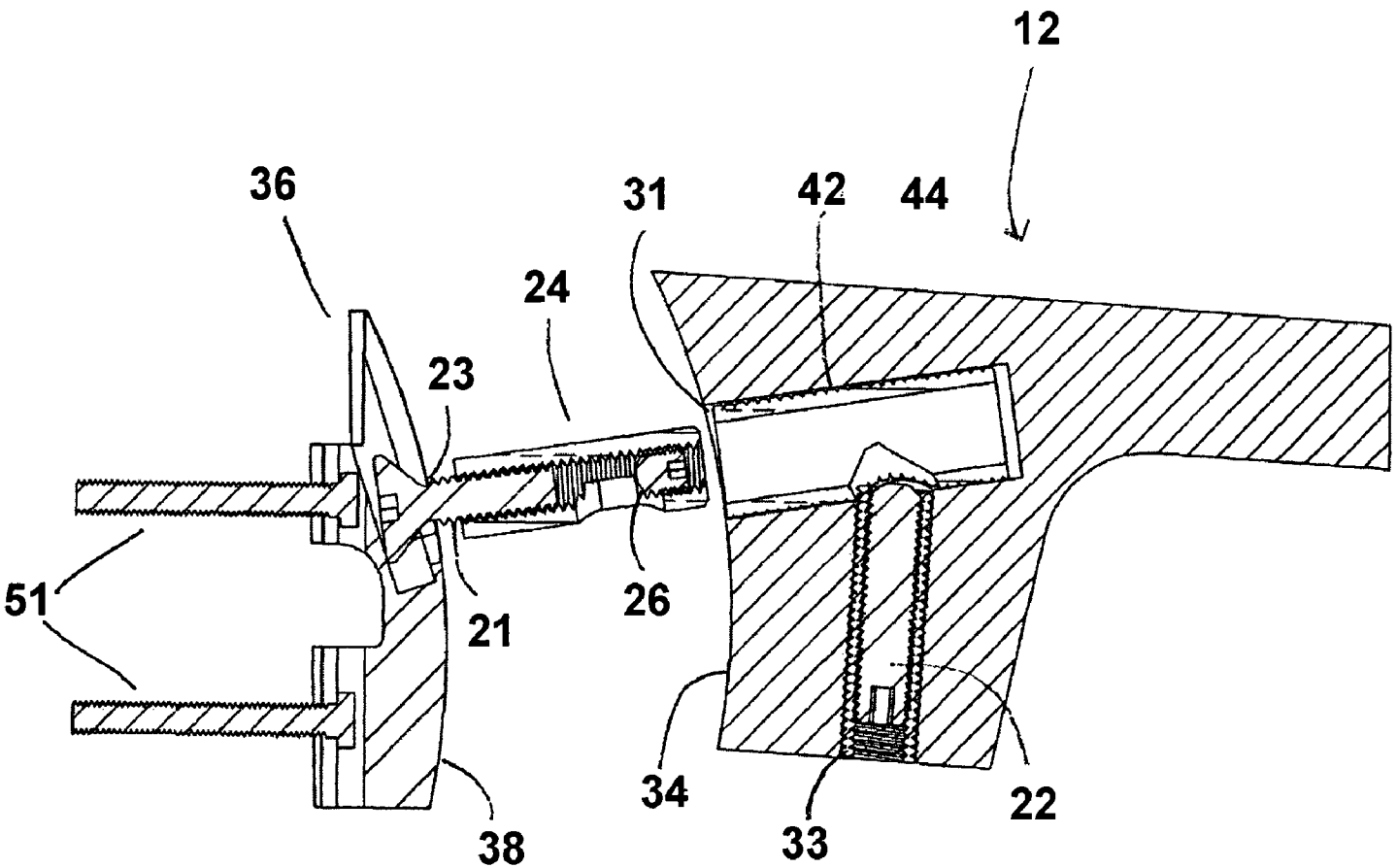
Fig. 5
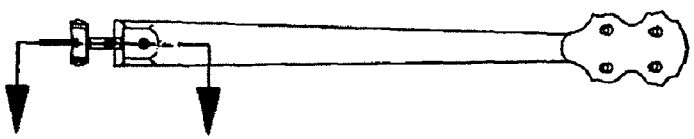

ADJUSTABLE AND REMOVABLE NECK FOR A STRINGED INSTRUMENT

BACKGROUND OF THE INVENTION

1. Summary of the Invention

The present invention relates to an adjustable and removable neck for a stringed instrument allowing disassembly as well as string action changes without disassembly.

2. Description of the Related Art

The most popular traditional banjo design over the last 50 years is referred to as the "Pre-War design" originally introduced by Gibson Instruments in the 1920's and 1930's. This design employs 24 hooks and nuts, a tension hoop, and a one or two piece flange attached to the circular wood and metal tone chamber called the pot. The pot assembly in turn is affixed to an immovable neck which is oriented to the pot at one specific angle. The most popular pre-war design employs two coordinator rods that span the interior of the pot and provide attachment points for a stable neck connection. The only neck angle adjustment available to owners of double coordinator rod banjos is to use the threaded ends of the rods to push or pull the pot out of cylindrical roundness in order to warp the pot enough to change the orientation of the neck angle to the playing surface or head. Needless to say this warping action is not an effective adjustment and can cause damage to the instrument.

The height or spacing of the strings above the fingerboard, often referred to as "action", is generally controlled by the height of the bridge and the angularity of the top surface of the neck relative to the body of the instrument. Tilting of the neck downwardly relative to the body of the instrument serves to bring the strings closer to the finger board and thus lowers the action. Conversely, tilting of the neck upwardly relative to the body tends to move the strings further away from the fingerboard, thus raising the action. The string/fingerboard spacing is generally a matter of personal preference for the player of the instrument. There is a range of desired action for an individual player. The preference is for the player to be able to maintain the action of the instrument as desired.

Various means have been suggested over the years to deal with neck angle adjustment in guitars, banjos and other stringed instruments. Banjoes made by Gretsch, and Harmony had a concave radiused portion on a banjo pot that mated with a concave end of the banjo neck whereby pivoting of the neck along the radius caused changes in the neck angle and resulting string action. The trouble with this adjustment was its tendency to slip, and the fact that in order to tighten up the connection it was necessary to remove the instrument's back to tighten the neck's fastener. Another problem with the above the adjustment is that its inherent geometry causes the fingerboard surface to tend lower in relation to the head surface as the string action (or height) is increased. Therefore if a low bridge is employed to hold the strings and proper sting action on the neck is achieved, there will be insufficient space for the clear picking of the strings without hitting the head.

There are numerous examples in the prior art of devices and systems for adjusting the action of a stringed musical instrument. Various stringed musical instruments having mechanisms or devices for permitting adjustment of the inclination of the neck. U.S. Pat. No. 6,265,648 describes a spring-loaded clamping device securing the neck to the body while permitting limited pivotal movement of the neck relative to the body. The clamping device includes a spring arranged to provide a biasing force and an adjustment member moveably mounted on either the neck or the body so as to move in a direction opposing the biasing force of the spring and adjusting the angular position of the neck relative to the body, thus adjusting the action of the instrument. In addition, U.S. Pat. No. 6,831,218 describes a movable adjustment member to adjust the angular position of the neck with respect to the instrument. The movable adjustment member may be finger manipulable and accessible through a sound hole as in an acoustic guitar. In addition, U.S. Pat. No. 7,157,634 allows a player to change the vertical height of the instrument's neck without affecting the angle of the neck relative to the guitar body and thus not affecting intonation or scale length. The invention has a height adjustment screw in back of the body and extending perpendicular to the neck which engages the body with the neck and allows adjustment of the vertical height of the neck relative to the body.

Many musicians prefer different action heights for different musical styles, and hence desire a means for changing of the action of their instruments quickly and conveniently, and in some instances even during a performance. A need exists for an adjustable neck on a stringed instrument which enables quick and easy neck angle adjustment for adjusting the action of the strings without requiring disassembly of the stringed instrument. A need also exists for a detachable neck on a stringed instrument for easy transportation of the stringed instrument.

SUMMARY OF THE INVENTION

Apparatus and methods in accordance with the present inventions may resolve many of the needs and shortcomings discussed above and will provide additional improvements and advantages as will be recognized by those skilled in the art upon review of the present disclosure.

Stringed instruments such as banjoes and guitars are typically set-neck instruments. The object of this invention is to provide a better mechanism for the easy adjustment and removal of a neck on a stringed instrument. The present invention enables quick and easy neck angle adjustments and the resulting string action changes without requiring any disassembly while maintaining the proper space for picking between the head and the strings. The present invention enhances the adjustability of helically mounted banjos, like that from Nechville Musical Products and disclosed in U.S. Pat. No. 5,033,349. The present invention can also be employed on other instrument designs including guitars and traditional banjos.

A musical instrument according to the present invention, typically a stringed instrument such as a banjo, comprises a neck, a body, a playing surface, a plurality of strings, and a connective element. The playing surface typically covers the body and is perpendicular to the cylinder of the pot. The connective element varies the distance of the plurality of strings from the playing surface of the instrument. The connective element comprises a set screw and a receiving unit having an inclined surface, with the set screw contacting the inclined surface on the receiving unit. The set screw adjustably fastens the receiving unit to the body and the neck. In addition, the connective element comprises a bolt screwably received in the connective element. The bolt projects through an aperture in the body and a bolt head of the bolt draws the body to contact of the neck when the set screw is tightened.

The neck has a radiused neck surface and the body has a radiused body surface. The body has a body top and a body bottom and the surface curvature of the radiused body surface extends from the body top to the body bottom. The neck has a neck top and a neck bottom and the surface curvature of the radiused neck surface extends from the neck top to the neck bottom. The surface curvature of the radiused body surface is transverse to the curvature of the body. The surface curvature of the radiused neck surface is also transverse to the curvature of the body.

A tightening of the set screw draws the neck toward the body and creates contact along and between the radiused neck surface and the radiused body surface. The set screw is continuously variable between an engaged position, where the radiused neck surface is in frictional contact with, and stationary with respect to, the radiused body surface, and a disengaged position where the receiving unit is disengaged from the neck, and the neck is released from the body, with the radiused neck surface not in frictional contact with the radiused body surface, and with the neck no longer in frictional contact with body. The radiused body surface may be convex. The radiused neck surface may be concave to be in perfect apposition to the convex surface of the body. Other shapes of the radiused body surface and radiused neck surface are also possible, including having the radiused neck surface being convex and the radiused body surface being concave.

The radiused body surface may be removable from the body allowing the mounting of a non-adjustable neck. The radiused neck surface may be removed from the neck allowing different mountings.

The present invention also discloses a removable interface for a musical instrument. The musical instrument has a neck, a body, strings and a playing surface covering the body. The removable interface is located between the neck and the body of the musical instrument. The removable interface is connected to the body. The connective element varies the distance of the strings from playing surface. The connective element comprises a set screw and a receiving unit having an inclined surface, with the set screw contacting the inclined surface on the receiving unit and adjustably fastening the receiving unit to the removable interface and the neck. In addition, the connective element comprises a bolt screwably received in the connective element. The bolt projects through a hole in the removable interface and a bolt head of the bolt draws the removable interface to contact the neck when the set screw is tightened.

The removable interface may have a radiused interface surface and the neck may have a radiused neck surface. The removable interface has an interface top and an interface bottom and a radiused interface surface extends from the interface top to the interface bottom. The radiused interface surface may have a curvature, transverse to a curvature of the body. The neck has a neck top and a neck bottom and the radiused neck surface had a neck curvature extending from the neck top to the neck bottom. The radiused neck surface is transverse to the curvature of the body in the engaged position.

Tightening of the set screw draws the neck toward the body and creates contact along the radiused interface surface and the radiused neck surface. The radiused neck surface may be concave and have an aperture to accept the receiving unit and the radiused interface surface may be convex. The set screw is continuously variable between an engaged position and a disengaged position. The receiving unit is disengaged from the neck and the removable interface in the disengaged position and the neck is released from the removable interface in the disengaged position. Other shapes of the radiused body surface and radiused neck surface are also possible, including having the radiused neck surface being convex and the radiused body surface being concave.

The radiused body surface may be removable from the body allowing the mounting of a non-adjustable neck. The radiused neck surface may be removed from the neck allowing different mountings.

I have devised an improvement over prior art instruments with adjustable angle necks that does not require disassembly, or access to the inside of the instrument, yet provides a better and more stable neck connection over a multitude of angles. Furthermore, the instrument disclosed here employs a convex radiused body surface and a concave radiused neck surface for attachment of the neck with the body. With the use of a low bridge to hold the strings and proper string action on the neck, there will be increased space for the clear picking of the strings without a player hitting the playing surface of the instrument. Another advantage of the present invention is ease of assembly of the neck and body connection.

Other features and advantages of the invention will become apparent from the following detailed description, and from the claims.

BRIEF DESCRIPTION OF THE DRAWINGS

All Figures are illustrated for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

FIG. 5 of the drawings shows a cross section of a removable interface of the musical instrument in the disengaged position.

DETAILED DESCRIPTION OF THE INVENTION

Figure 1:
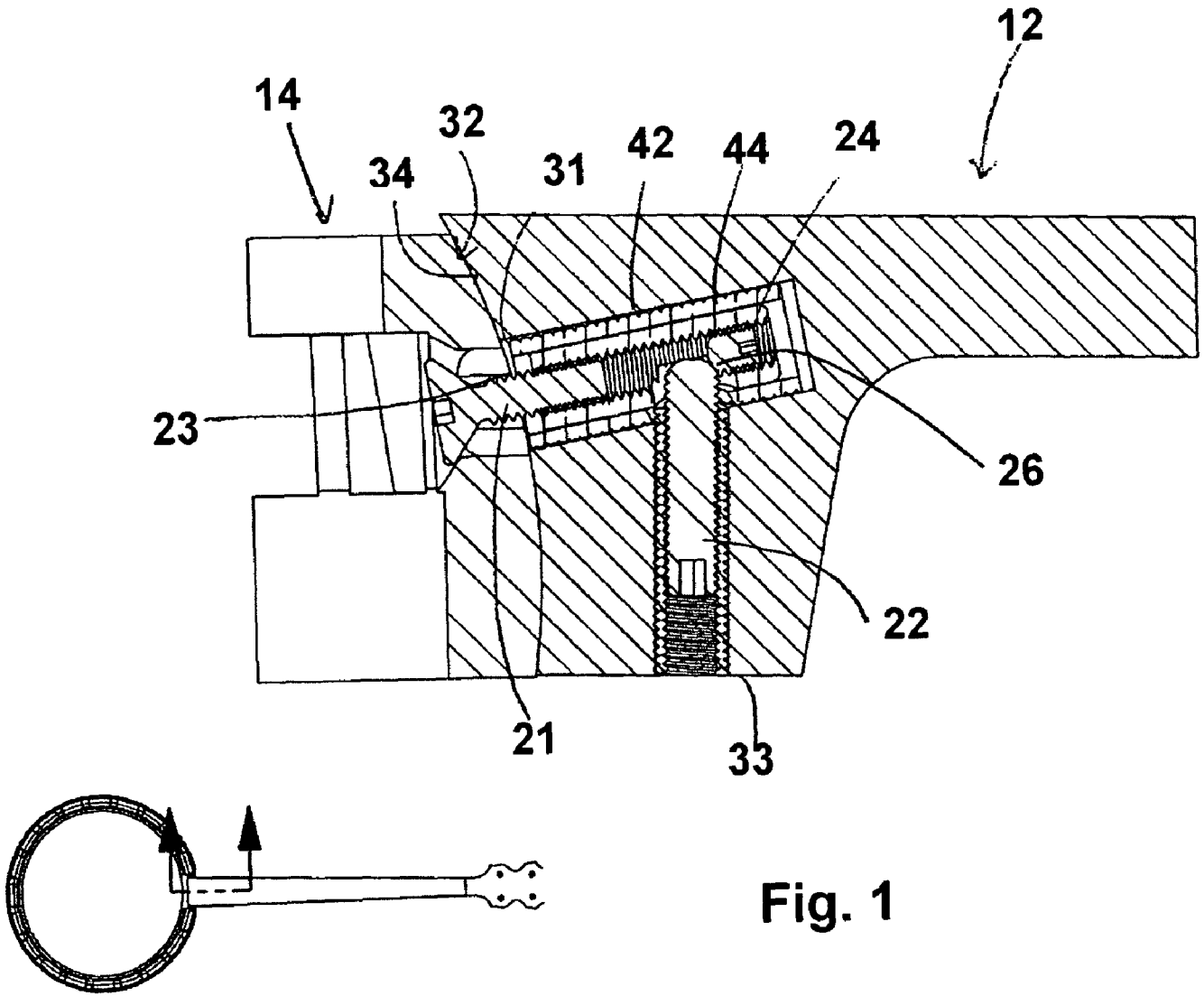
FIG. 1 of the drawings shows a cross section of the musical instrument in the engaged position.

The figures generally illustrate exemplary embodiments of a musical instrument 10 or components thereof which include aspects of the present inventions. The particular embodiments of the musical instrument 10 illustrated in the figures have been chosen for ease of explanation and understanding of various aspects of the present inventions. These illustrated embodiments are not meant to limit the scope of coverage but instead to assist in understanding the context of the language used in this specification and the appended claims.

The musical instrument 10 is preferably a banjo in accordance with the present invention although the invention relates to other instruments with a neck 12, a body 14, a playing surface 16, a bridge 17 and strings 18.

Figure 2:
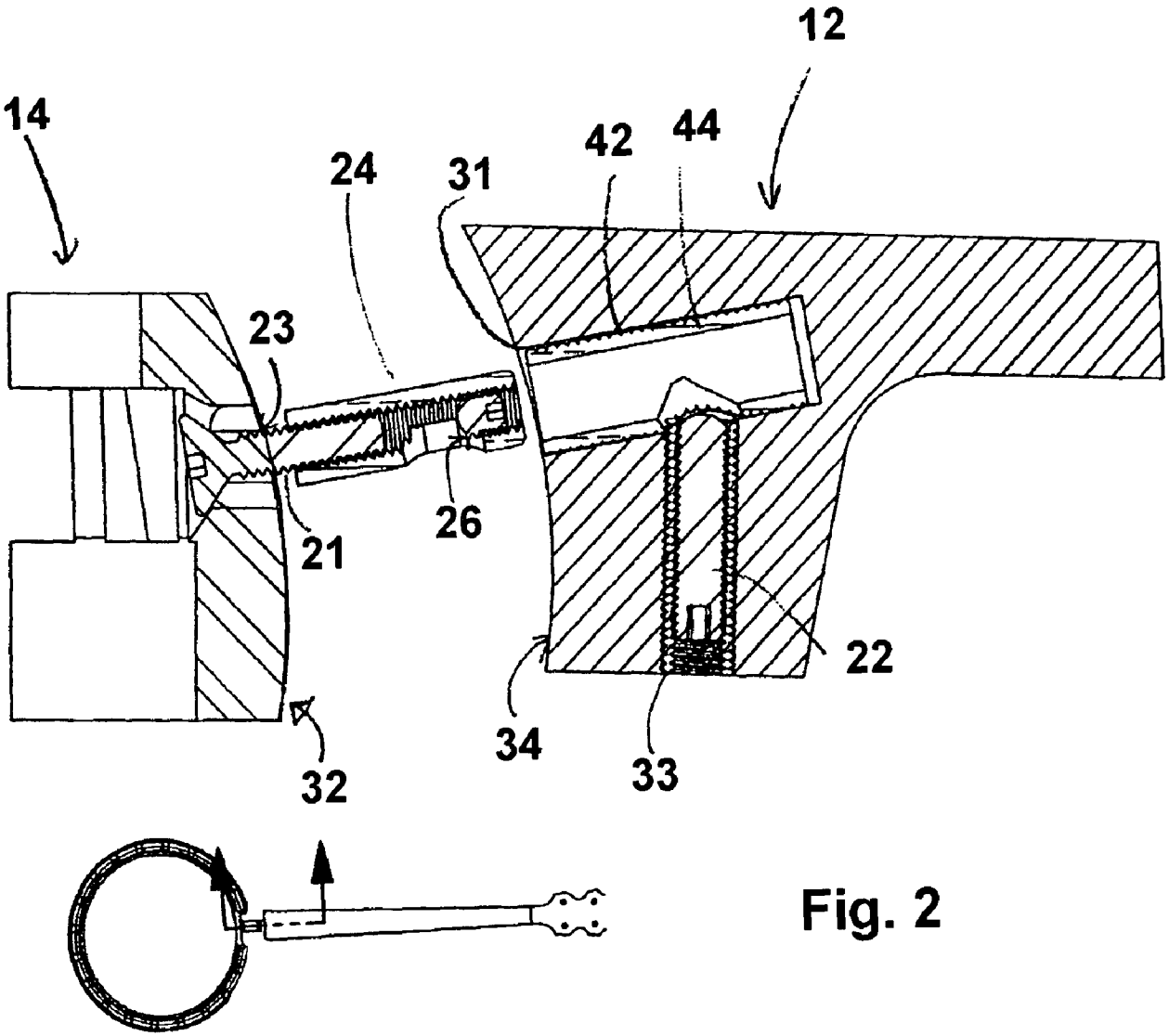
FIG. 2 of the drawings shows a cross section of the musical instrument in the disengaged position.
Figure 3:
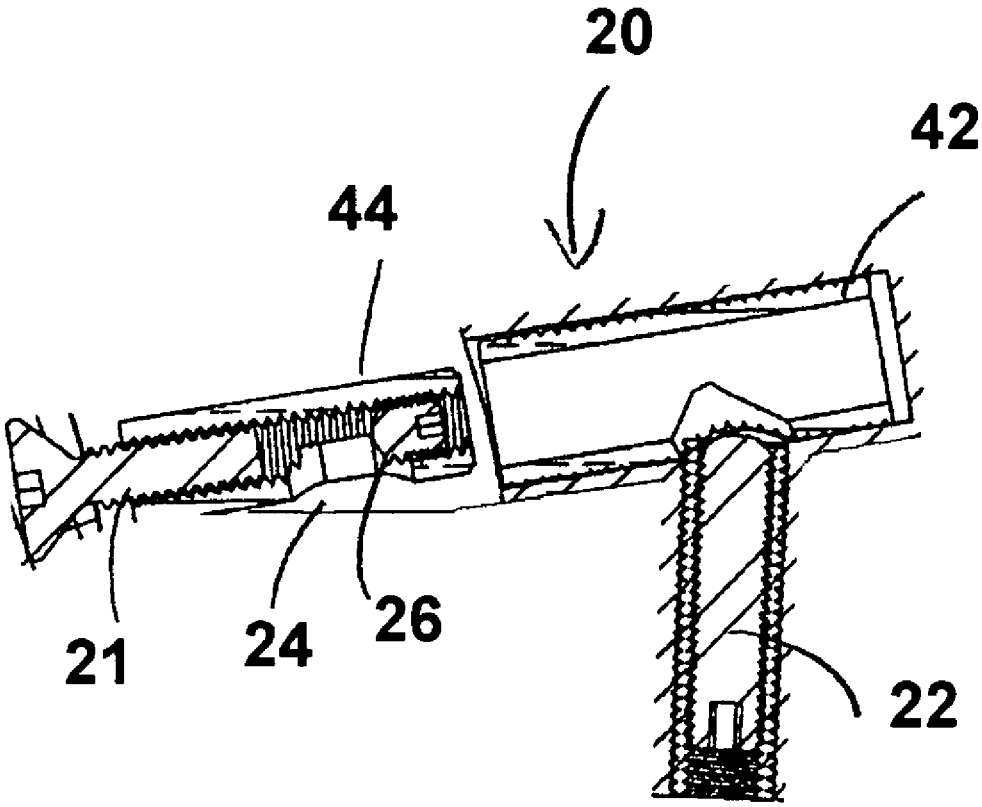
FIG. 3 of the drawings shows a cross section of the connective element.

A first embodiment of the musical instrument 10 is illustrated in FIGS. 1 and 2. The musical instrument 10 of the present invention comprises a neck 12, a body 14, a playing surface 16, a plurality of strings 18, and a connective element 20. The connective element 20 is used to vary the distance of the plurality of strings 18 from the playing surface 16 of the musical instrument 10. The body 18 may be of the helical mount style or other styles. The neck 12 attaches to the body 14 by way of the connective element 20. The connective element 20 comprises a set screw 22 and a receiving unit 24 having an inclined surface 26, as illustrated in FIG. 3. The bolt and receiving unit may alternately be replaced by a one piece machined part, serving the same function. The neck has a first cavity 31 and a second cavity 33, with the first cavity 31 meeting the second cavity 33 internal at an oblique angle and internal to the neck 12. A threaded bushing 42 may be used to strengthen the neck 12 and prevent cracks. The sleeve 44 may also be inserted into the first cavity 31 in the neck 12. The receiving unit 24 is slidably received in the sleeve 44 in the first cavity 31. The threading of the bushing 42 into the sleeve 44 enhances the structural soundness of the connection of the neck 12 to the body 14 and places all the stresses of connection on the bushing 42 and the sleeve 44, rather than on the material of the neck 12, which is normally wood. In addition, the connective element 20 further comprises a bolt 21 screwably received in the connective element 20. The bolt 21 projects through an aperture 23 in the body 14 and a bolt head of the bolt 21 draws the body 14 to contact the neck 12 when the set screw 22 is tightened against the inclined surface 26. The set screw 22 is screwably received in the second cavity 33 in the neck 12. The set screw 22 is disposed at a first oblique angle to the receiving unit 24. The second cavity 33 and the set screw 22 are disposed at a second oblique angle to a longitudinal axis extending from the body 14 along a center of the neck 12. The second cavity and the set screw 22 may be on a bottom of the neck 12, a first side of the neck 12, a second side of the neck 12, a top of the neck 12 or an intermediate position between the bottom, the top, the first side and the second side of the neck 12.

The neck 12 is attached to the body 14 by the set screw 22, with a rounded end of the set screw 22 screwed against an inclined surface 26 of a receiving unit 24. The inclined surface 26 of the receiving unit 24 is disposed at a third oblique angle to the first cavity 31. The inclined surface 26 may slant toward the body 14, as illustrated in FIG. 1.

The set screw 22 is screwably received in first cavity 31. The inclined surface 26 is fixed inside the receiving unit 24 which is fastened adjustably to the body 14. The neck 12 has a radiused neck surface 34 and the body 14 has a radiused body surface 32. When the rounded surface of the set screw 22 contacts the inclined surface 26, the neck 12 draws toward the body 14 and the radiused neck surface 34 contacts the radiused body surface 32. The set screw 22 allows the reversible attachment of the neck 12 and the body 14. As the set screw 22 is screwed in, the contact between the inclined surface 26 and the receiving unit 24 frictionally increases. The radiused neck surface 34 is in direct contact with the radiused body surface 32 allowing a firm and stable attachment between the neck 12 and the body 14. As the set screw 22 is screwed out, the contact between the inclined surface 26 and the receiving unit 24 frictionally decreases. The neck 12 and the body 14 may either be detached from one another for transportation or the neck 12 may be adjusted relative to the body 14 to adjust the action on the strings 16.

Figure 4:
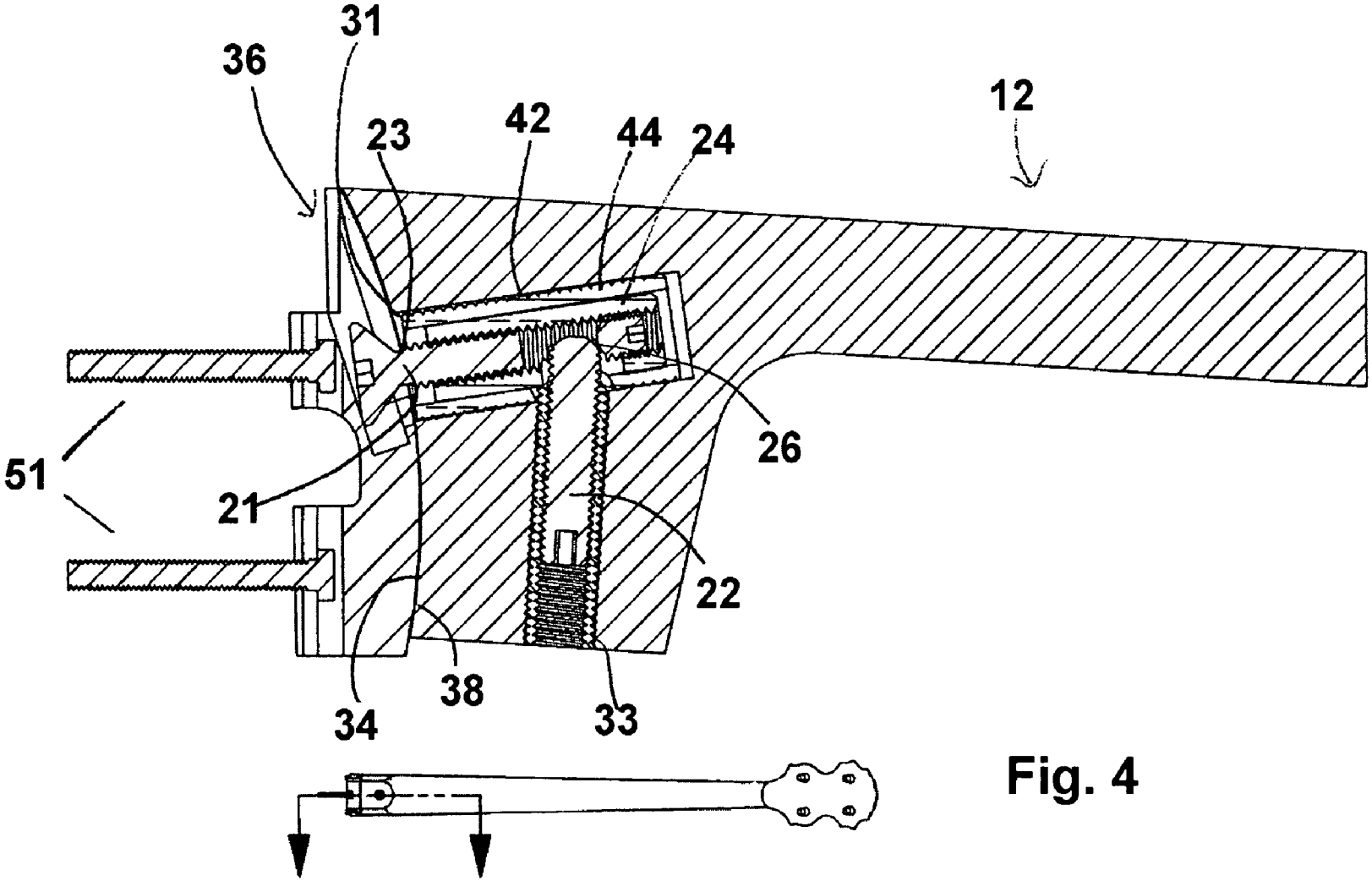
FIG. 4 of the drawings shows a cross section of a removable interface of the musical instrument in the engaged position.

An alternative embodiment of the musical instrument 10 is illustrated in FIGS. 4 and 5. In the alternative embodiment, a removable interface 36 is connected with the neck 12 and the body.

The connective element 20 is used to vary the distance of the plurality of strings 18 from the playing surface 16 of the musical instrument 10. The body 18 may be of the helical mount style or other styles. The neck 12 attaches to the removable interface 36 by way of the connective element 20. The connective element 20 comprises a set screw 22 and a receiving unit 24 having an inclined surface 26, as shown in FIG. 3. A threaded bushing 42 may be used to strengthen the neck 12 and prevent cracks. A sleeve 44 may also be inserted into a first cavity 31 in the neck 12. The receiving unit 24 is slidably received in the first cavity 31. The threading of the bushing 42 into the sleeve 44 enhances the structural soundness of the connection of the neck 12 to the removable interface 36 and places all the stresses of connection on the bushing 42 and the sleeve 44, rather than on the material of the neck 12, which is normally wood. In addition, the connective element 20 further comprises a bolt 21 screwably received in the connective element 20. The bolt 21 projects through an aperture 23 in the removable interface 36 and a bolt head of the bolt 21 draws the removable interface 36 to contact the neck 12 when the set screw 22 is tightened against the inclined surface 26. The set screw 22 is screwably received in a second cavity 33 in the neck 12. The second cavity 33 meets the first cavity 31 in the neck at an oblique angle. The set screw 22 is disposed at a first oblique angle to the receiving unit 24. The second cavity 33 and the set screw 22 are disposed at a second oblique angle to a longitudinal axis extending from the body 14 along a center of the neck 12. The second cavity and the set screw 22 may be on a bottom of the neck 12, a first side of the neck 12, a second side of the neck 12, a top of the neck 12 or an intermediate position between the side, the top, the first side and the second side of the neck 12.

The neck 12 is attached to the removable interface 36 by the set screw 22, with a rounded end of the set screw 22 screwed against an inclined surface 26 of a receiving unit 24. The inclined surface 26 of the receiving unit 24 is disposed at a third oblique angle to the first cavity 31. The inclined surface 26 may slant toward the removable interface 36, as illustrated in FIG. 4.

The set screw 22 is screwably received in first cavity 31. The inclined surface 26 is fixed inside the receiving unit 24 which is fastened adjustably to the removable interface 36. The neck 12 has a radiused neck surface 34 and the removable interface 36 has a radiused interface surface 38. When the rounded surface of the set screw 22 contacts the inclined surface 26, the neck 12 draws toward the removable interface 36 and the radiused neck surface 34 contacts the radiused interface surface 38. The set screw 22 allows the reversible attachment of the neck 12 and the body 14. As the set screw 22 is screwed in, the contact between the inclined surface 26 and the receiving unit 24 frictionally increases. The radiused neck surface 34 is in direct contact with the radiused interface surface 38 allowing a firm and stable attachment between the neck 12 and the removable interface 36. As the set screw 22 is screwed out, the contact between the inclined surface 26 and the receiving unit 24 frictionally decreases. The neck 12 and the removable interface 36 may either be detached from one another for transportation or the neck 12 may be adjusted relative to the removable interface 36 to adjust the action on the strings 16.

Figure 6A:
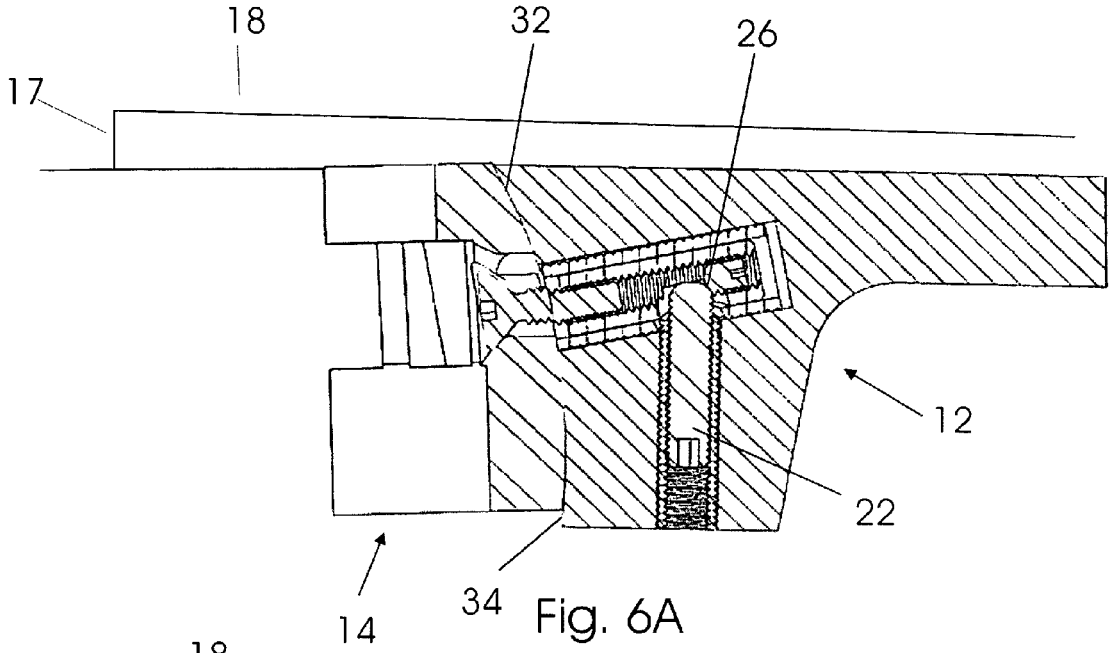
FIG. 6A of the drawings shows a cross section of the musical instrument with the neck tilted downward relative to the body.
Figure 6B:
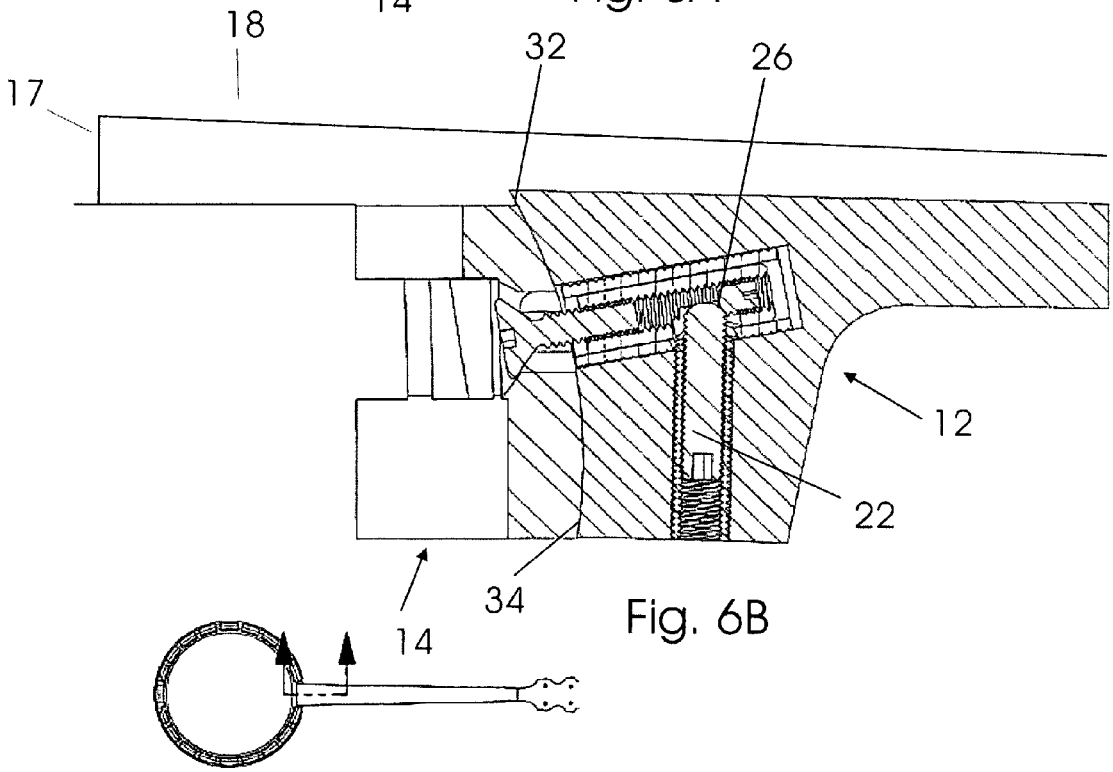
FIG. 6B of the drawings shows a cross section of the musical instrument with the neck tilted upward relative to the body.

The adjustment of the string height or action of the musical instrument 10 is illustrated in FIGS. 6A and 6B. In FIG. 6A, the body 14 is elevated relative to the neck 12. In FIG. 6B, the body 14 is depressed relative to the neck 12. The bridge 17 is of a constant height in FIGS. 6A and 6B. The strings 18 are closer to the neck 12 with lower action in FIG. 6A. The strings 18 are further from the neck 12 with higher action in FIG. 6B.

Screwable movement of the set screw 22 allows the action of the instrument 10 to be adjusted immediately. This adjustment does not put any stress on the body 14.

Figures 7A, 7B:
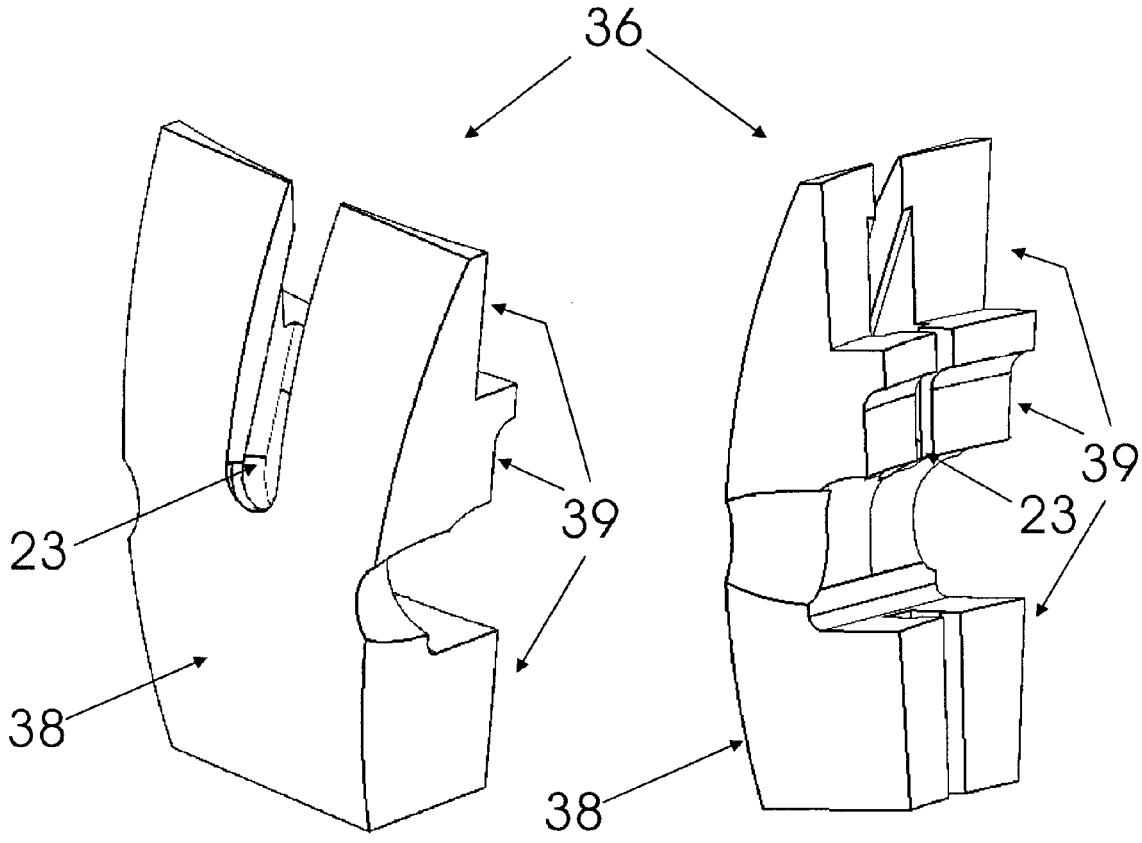
FIG. 7A of the drawings shows a first isometric view of the connective element.
FIG. 7B of the drawings shows a second isometric view of the connective element.

The removable interface 36 has a radiused interface surface 38 and an interface/body surface 39 with the radiused interface surface 38 separated from the interface/body surface 39, as shown in FIGS. 7A and 7B. The removable interface 36 has an aperture 23 allowing a connector to connect the removable interface 36 with the neck 12. The connector may be a bolt 21 as shown in FIGS. 5 and 6.

In operation, a user could either disassemble the instrument 10 for transport or adjust the height or action of the strings 18 relative to the playing surface 16. The instrument 10 is illustrated in FIG. 1 in assembled form and in FIG. 2 in disassembled form. In FIG. 1, the set screw 22 is in the engaged position and in FIG. 2 the set screw 22 is in the disengaged position. In FIG. 1, the neck 12 and body 14 are in close contact along the radiused neck surface 34 and the radiused body surface 32, in the engaged position. Screwing the set screw 22 out of the second cavity 33 reduces frictional contact of the set screw 22 with the inclined surface 26 of the receiving unit 24. As the frictional contact of the set screw 22 with the receiving unit 24 decreases, the engagement of the neck 12 and the body 14 decreases. As this frictional contact decreases, the strings 18 become less taut above the neck 12 and the body 14. As the set screw 22 is screwably further removed from the second cavity 33, the inclined surface 26 of the receiving unit 24 no longer contacts the rounded end of the set screw 22 and the receiving unit 24 is free to be withdrawn from the first cavity 31. When the receiving unit 24 is completely removed from the first cavity 31, the neck 12 and body 14 are completely separated, as illustrated in FIG. 2, the disengaged position. In the disengaged position, the instrument 10 with the neck 12 and body 14 completely separated can packed up for travel.

It is also possible to adjust the height or action of the strings 18 relative to the playing surface 16. The set screw 22 can be partially unscrewed reducing the frictional contact with the inclined surface 26 of the connective element 20. When the frictional contact between the set screw 22 and the inclined surface 26 is sufficiently reduced, the body 14 can be moved relative to the neck 12 altering the height of the strings 18 above the neck 12 and the playing surface 16. FIGS. 6A and 6B show two positions of the body 14 relative to the neck 12. As shown in FIG. 6A, the body 14 is elevated relative to the neck 12 and in FIG. 6B, the body 14 is depressed relative to the neck 12. The bridge 17 is of a constant height in FIGS. 6A and 6B. The strings 18 are closer to the neck 12 with lower action in FIG. 6A. The strings 18 are further from the neck 12 with higher action in FIG. 6B. When the desired relative locations of the neck 12 and the body 14 are achieved, the set screw 22 can be screwed in to increase the frictional contact with the inclined surface 26.

The instrument 10 with the removable interface 36 is illustrated in FIG. 4 in assembled form and in FIG. 5 in disassembled form. In FIG. 4, the set screw 22 is in the engaged position and in FIG. 5 the set screw 22 is in the disengaged position. In FIG. 4, the neck 12 and the removable interface 36 are in close contact along the radiused neck surface 34 and the radiused interface surface 38, in the engaged position. Screwing the set screw 22 out of the second cavity 33 reduces frictional contact of the set screw 22 with the inclined surface 26 of the receiving unit 24. As the frictional contact of the set screw 22 with the receiving unit 24 decreases, the engagement of the neck 12 and the removable interface 36 decreases. As this frictional contact decreases, the strings 18 become less taut above the neck 12, the removable interface 36 and the body 14. As the set screw 22 is screwably further removed from the second cavity 33, the inclined surface 26 of the receiving unit 24 no longer contacts the rounded end of the set screw 22 and the receiving unit 24 is free to be withdrawn from the first cavity 31. When the receiving unit 24 is completely removed from the first cavity 31, the neck 12 and removable interface 36 are completely separated, as illustrated in FIG. 5, the disengaged position. In the disengaged position, the instrument 10 with the neck 12, removable interface 36 and body 14 completely separated can packed up for travel.

The foregoing discussion discloses and describes merely exemplary embodiments of the present invention. Upon review of the specification, one skilled in the art will readily recognize from such discussion, and from the accompanying drawings and claims, that various changes, modifications and variations can be made therein without departing from the spirit and scope of the invention as defined in the following claims.

What is claimed is:

1. A musical instrument comprising a neck, a body, a playing surface covering the body, a plurality of strings, and a connective element varying the distance of the plurality of strings from the playing surface of the instrument, with the connective element comprising a set screw, a threaded bolt and a receiving unit, with the threaded bolt having a bolt aperture with an inclined surface along the shaft of the threaded bolt, with the set screw removably protruding through the bolt aperture and contacting the inclined surface on the bolt aperture on the receiving unit and adjustably fastening the receiving unit to the body and the neck, with the neck having a radiused neck surface, with the connective element having a radiused body surface the threaded bolt being secured within the receiving unit and where the receiving unit fits into a sleeve secured within the neck, and with a tightening of the set screw drawing the neck toward the body and creating contact along and between the radiused neck surface and the radiused body surface.

2. The musical instrument of claim 1, with the radiused neck surface being concave and having an aperture to accept the receiving unit and with the radiused body surface being convex.

3. The musical instrument of claim 2, with the set screw continuously variable between an engaged position and a disengaged position, with the receiving unit disengaged from the neck and the body in the disengaged position and with the neck released from the body in the disengaged position.

4. The musical instrument of claim 1, with the radiused body surface removable from the neck.

5. The musical instrument of claim 2 with the radiused body surface removable from the neck.

6. The musical instrument of claim 3 with the radiused body surface removable from the neck.

7. The musical instrument of claim 6 with the radiused body surface containing the connective element, with the radiused body surface connected adjustably and radially to the neck and with the radiused body surface perpendicular to the playing surface.

8. The musical instrument of claim 1 with the radiused neck surface removable from the body.

9. The musical instrument of claim 4 with the radiused neck surface removable from the body.

10. The musical instrument of claim 7 with the radiused neck surface removable from the body.

11. A removable interface for a musical instrument, with the musical instrument having a neck, a body, strings and a playing surface covering the body, with the removable interface between the neck and the body of the musical instrument, with the removable interface connected with the body, with the removable interface comprising a connective element to vary the distance of the strings from playing surface, with the connective element comprising a set screw, a threaded bolt and a receiving unit, with the threaded bolt having a bolt aperture with an inclined surface along the shaft of the threaded bolt, with the set screw removably protruding through the bolt aperture and contacting the inclined surface on the bolt aperture on the receiving unit and adjustably fastening the receiving unit to the neck, with the removable interface having a radiused interface surface, with the neck having a radiused neck surface the threaded bolt being secured within the receiving unit and where the receiving unit fits into a sleeve secured within the neck, and with a tightening of the set screw drawing the neck toward the body and creating contact along the radiused interface surface and the radiused neck surface.

12. The removable interface of claim 11, with the radiused neck surface being concave and having an aperture to accept the receiving unit and with the radiused interface surface being convex.

13. The removable interface of claim 12, with the set screw continuously variable between an engaged position and a disengaged position, with the receiving unit disengaged from the neck and the removable interface in the disengaged position and with the neck released from the removable interface in the disengaged position.

* * * * *